United States Patent [19]

Barber et al.

[11] 4,181,929

[45] Jan. 1, 1980

[54] PORTABLE ILLUMINATING TOWER

[75] Inventors: Gerald L. Barber; Wayne Comstock, both of Greenville, S.C.

[73] Assignees: Venture Ride Mfg. Inc., Greer; High-Lite Corporation, Greenville, both of S.C.

[21] Appl. No.: 757,389

[22] Filed: Jan. 6, 1977

[51] Int. Cl.[2] ..... F21L 13/06; F21L 15/08; F21S 3/10

[52] U.S. Cl. ..... 362/192; 248/167; 362/234; 362/413; 362/431

[58] Field of Search ..... 240/2 R, 6.4 R, 10.5, 240/64, 67, 81 H; 248/161, 167; 362/192, 228, 234, 253, 382, 391, 403, 413, 414, 431

[56] References Cited

U.S. PATENT DOCUMENTS

| | | | |
|---|---|---|---|
| 1,573,398 | 2/1926 | Griffith | 248/167 |
| 2,081,248 | 5/1937 | Murphy | 248/161 X |
| 2,453,442 | 11/1948 | Lewis | 248/167 X |
| 2,464,031 | 3/1949 | Fiedel | 248/167 |
| 2,899,540 | 8/1959 | Allmand et al. | 240/67 X |
| 3,292,322 | 12/1966 | Pfaff et al. | 240/67 X |
| 3,586,270 | 6/1971 | Loffler et al. | 240/67 X |
| 3,832,937 | 9/1974 | Moore et al. | 91/167 R |

*Primary Examiner*—Fred L. Braun

*Attorney, Agent, or Firm*—Albert L. Jeffers; John F. Hoffman

[57] ABSTRACT

A portable illuminating tower in which a base frame is provided having a vertically extensible column mounted thereon together with a source of pressurized gas for effecting extension of the tower. An engine driven generator is carried by the base frame for energizing light fixtures carried on the upper end of the extensible column. The base frame is provided with outriggers or wings which can be swung outwardly to brace the base frame when the column is extended. The unit is compact and lightweight and can readily be transported from place to place.

18 Claims, 7 Drawing Figures

PORTABLE ILLUMINATING TOWER

The present invention relates to vertically extensible illuminating tower structures, and is particularly concerned with such a structure which is of such a nature that it can readily be moved about.

Light tower structures are known and a tower of the general nature with which the present application is concerned is disclosed in the Moore et al. U.S. Pat. No. 3,832,937. The tower disclosed in the patent includes a gas operated, vertically extensible column adapted for supporting light fixture means on the upper end.

The present invention is concerned with an illuminating tower that embodies a vertically extensible column, but in which the column has the lower base end connected to a base frame which is constructed and arranged for ready portability and on which is mounted an engine driven generator and a source of gas under pressure for actuation of the extensible column. The arrangement of the present invention is particularly well adapted for use in connection with mobile enterprises, such as carnivals and the like, on construction sites, for emergency use and the like.

An object of the present invention is the provision of an extensible light tower which is compact when collapsed and which is provided with means for easily transporting the tower from one place of use to another.

A still further object of the present invention is the provision of a portable, vertically extensible illuminating tower which is entirely self-contained and requires no external power connections in order to utilize the tower when it is disposed in a place of use.

Still another object is the provision of a portable, vertically extensible illuminating tower which is relatively inexpensive to manufacture.

BRIEF SUMMARY OF THE INVENTION

According to the present invention, a vertically extensible illuminating tower is provided in which a base frame is constructed utilizing tubing or the like. The base frame is adapted for receiving a motor driven generator, a vertically extensible column having light fixture means at the upper end, and a source of gas under pressure for supplying gas to the column to effect extension thereof.

The piping leading to the column for supplying gas thereto has a shut off valve therein, and between the shut off valve and the column is a normally closed valve, such as a relief valve, which can be manually opened to permit retraction of the tower after the shut off valve has been closed.

The base frame has side rails which protect the equipment mounted thereon and has outwardly swingable outriggers that provide for widely spaced points of support for the base frame when the column is erected, thereby imparting stability to the extended unit.

The outriggers are swingable inwardly against the sides of the base frame, and when so located, present handles at one end of the frame for lifting the frame for transport thereof. When the outriggers are swung outwardly, the handles engage the front of the base frame and stop the outriggers in a desired position whereupon the outriggers can be interconnected by a bar to hold them in proper bracing position.

Any suitable light fixture means can be mounted on the upper end of the extensible column, but it is preferred to employ, for example, high intensity quartz iodine lamps so that a substantial area can be illuminated.

The exact nature of the present invention will become more clearly apparent upon reference to the following detailed specification taken in connection with the accompanying drawings in which.

DETAILED DESCRIPTION OF THE INVENTION

Figure 1:
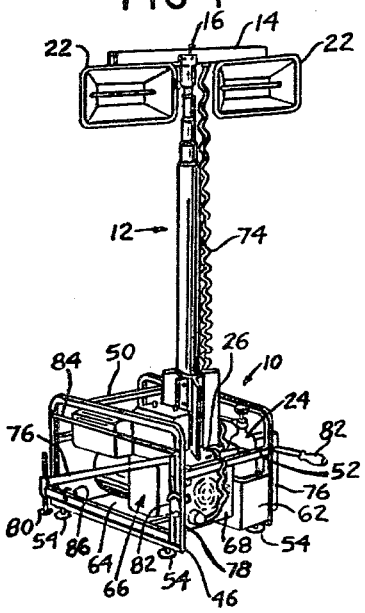
FIG. 1 is a perspective view showing a unit according to the present invention in collapsed position.

Referring to the drawings somewhat more in detail, the vertically extensible illuminating tower according to the present invention comprises a base frame, generally designated with reference numeral 10, and a column, generally designated with reference numeral 12, and mounted on the base frame. Column 12, as will be seen, comprises a plurality of telescopically engaged tubular sections which can be extended from the collapsed position in which they are shown in FIG. 1 vertically upwardly.

The amount of extension in the vertical direction of the column is substantial. The assembly illustrated in FIG. 1, when collapsed, has an overall height of 71 inches, but when the column is extended to the limit in the vertical direction, the overall height of the unit is 16 feet 6 inches.

Figure 5:
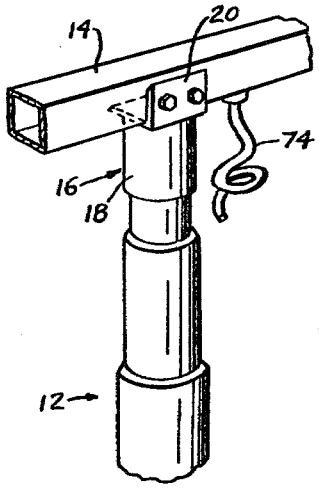
FIG. 5 is a view at the top of the extensible column showing the connection of the fixture bar thereto.

The extensible column has mounted on the upper end of the uppermost section a transversely extending light bar 14 which, in the center, is connected to a fitting 16 in the form of a cup adapted for being connected to the uppermost end of the upper section of column 12. The arrangement of the light bar and the fitting 16 is shown in FIG. 5, wherein it will be seen that fitting 16 consists of a lower tubular portion 18 and an angle member 20 mounted on top thereof and bolted to the center of light bar 14.

Light bar 14 has a light fixture 22 on each end thereof with each light fixture advantageously consisting of a high intensity quartz iodine lamp which will provide illumination for a substantial area. The light fixtures 22 may be tiltable on the light bar and the light fixtures, together with the uppermost section of tower 12, can be rotated through 360 degrees.

The raising and lowering of the column is accomplished by gas under pressure which is derived from a gas bottle 24 carried in base frame 10 and connected by conduit means 26 with the lower end of the lowermost section of column 12.

Figure 2:
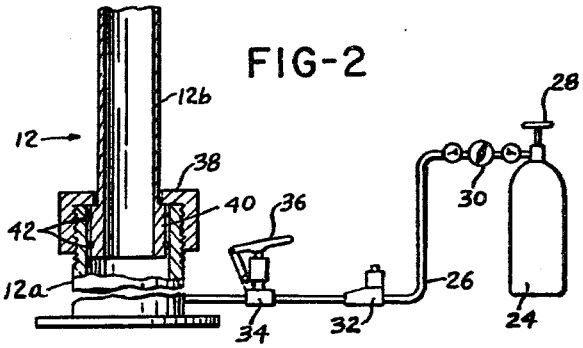
FIG. 2 is a piping diagram showing schematically the manner in which a gas bottle carried on the base frame of the tower structure is connected in circuit with the vertically extensible tower.

FIG. 2 shows the bottle 24 and conduit means 26 in the lower end of column 12 somewhat diagrammatically. In FIG. 2, it will be seen that the tank 24, which may consist of a $CO_2$ or nitrogen tank, has a shut off valve 28 at the upper end and supplies gas through a regulator 30, which may be set at, say, 65 pounds per square inch, and an oiler 32 and a relief valve 34 to the bottom of column 12. Relief valve 34 is set at, say, 70 pounds and is adapted for manual actuation by lever 36 into open position. Oiler 32, as is known, merely supplies oil to the gas to maintain the column lubricated.

FIG. 2 also shows that one column section, as at 12*a*, has a nut 38 connected to the upper end thereof, while the lower end of the next uppermost column section 12*b* has a piston portion 40 formed on the lower end, with seal ring means 42 carried by the piston and sealing between the piston and the inner wall of column section 12*a*. In the manner illustrated, the column sections can be caused to extend and collapse by controlling the pressure of the fluid supplied to the lowermost one of the sections.

In operation, opening of valve 28 will cause extension of the column from collapsed position to fully extended position in about five seconds and, when it is desired to collapse the column, valve 28 is closed and valve 34 is opened by actuation of lever 36.

Figure 3:
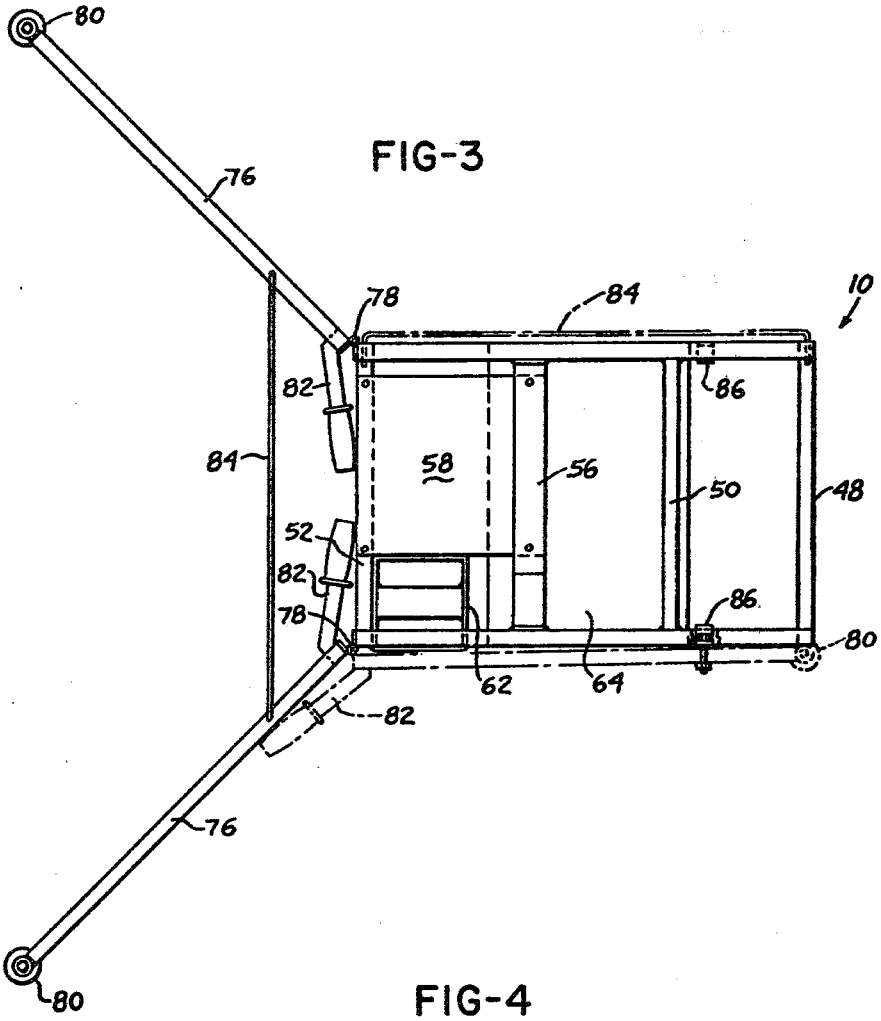
FIG. 3 is a plan view of the base frame of the structure.
Figure 4:
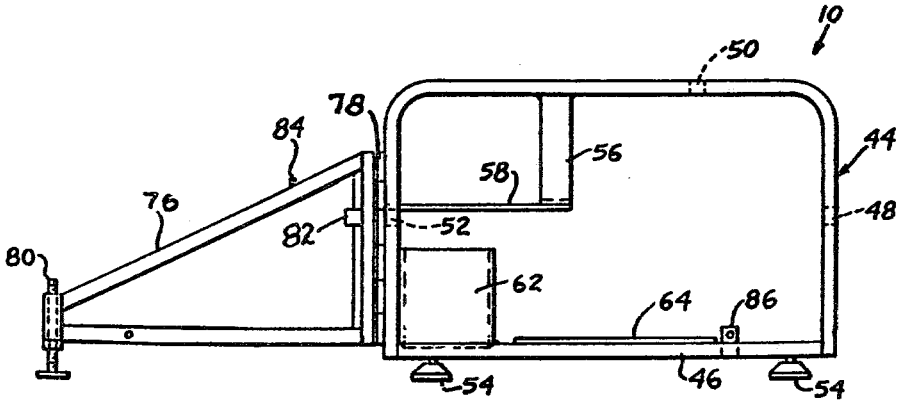
FIG. 4 is a side view of the base frame of the structure.

The base frame, per se, is shown more in detail in FIGS. 3 and 4, wherein it will be seen that frame 10 is made up of, for example, one inch tubing elements which are bent to form sides 44 with longitudinal rails 46 extending in the fore and aft direction and each side of the base frame and with transverse members 48, 50 and 52 extending laterally between the sides as illustrated in FIGS. 3 and 4. The tubular members referred to are interconnected by welding. Each of longitudinal rails 46 is provided with ground engaging pads 54 for supporting the base frame on a supporting surface.

Figure 6:
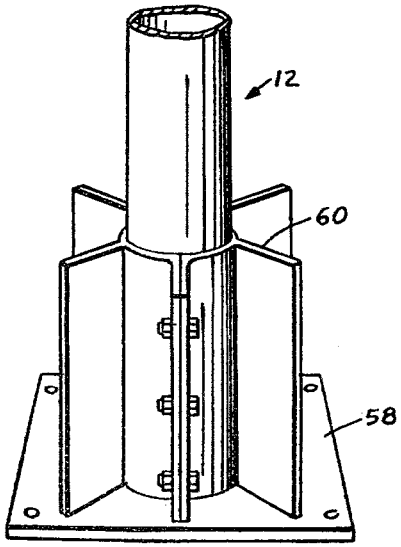
FIG. 6 is a perspective view showing the manner in which the extensible column is connected to the supporting base plate therefor.

The frame includes a strap element 56 extending transversely therein and welded to the top rails of the sides of the base frame. The aforementioned column is provided with a base member illustrated in FIG. 6 and which includes a supporting base plate 58 and a gusseted member 60 upstanding therefrom and adapted for receiving the base of extensible column 12.

Base plate 58 is adapted for having the rear edge bolted to strap 56 in engagement with the underside thereof and to the upper side of rail 52. The extensible column 12 is thus supported near the front end of base frame 10 and to one side thereof. In base frame 10, at one side of base plate 58, is a socket 62 welded in position in the base frame and adapted for supporting the gas bottle 24.

The base frame also includes a support plate 64 therein on which is mounted an engine-generator set generally indicated at 66 in FIG. 1. The engine-generator set 66 has a front panel 68 with a plurality of sockets therein, of which sockets 70 may be at 110 volts and socket 72 at 220 volts. Socket 72 supplies power via the flexible power cord 74 to the light fixtures 22 mounted on light bar 14.

Figure 7:
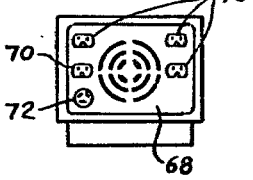
FIG. 7 is a fragmentary view showing an end panel of an electric generator forming a part of the unit of the present invention.

FIG. 7 shows an end view of panel 68 at the end of the generator having the sockets 70 and 72 therein and also showing inlets for the passage of cooling air for the generator.

The motor for the generator may have a recoil starter or it may have a power starter under the control of a circuit connected to a battery carried in the base frame 10 and maintained in energized condition by power from the generator in the base frame.

When the unit according to the present invention is collapsed, as shown in FIG. 1, it can readily be moved about, and when it is brought to a place of use and set down on a supporting surface, brace means in the form of a pair of outriggers 76, one on each side of the base frame 10, and each pivoted by hinge means 78 to the forward edge of the base frame, are swung outwardly into the position shown in FIG. 3, and the adjustable pads 80 carried on the outer ends thereof are adjusted into engagement with the supporting surface.

Each outrigger or arm member has a handle member 82 which extends outwardly at an angle when the outriggers are folded back which serve as stops for the outriggers when the outriggers are folded outwardly, as will be seen in FIG. 1. The handles 82 are positioned at about the level of the transverse rail means 52 at the front of the base frame and abut this rail and stop the outriggers in their outer positions, as shown in FIG. 3.

Furthermore, a holding bar 84 can be provided which has turned down end portions that engage holes provided in the outriggers to hold the outriggers in outwardly swung position. When the outriggers are swung back against the frame, bar 84 can be carried on the frame as indicated in FIG. 1.

The lower rails 46 of the base frame have clips 86 thereon for bolts which extend through the outriggers to clamp the outriggers in folded back position as shown in FIG. 1 in respect of the outrigger in dot-dash position. When the outriggers are bolted in folded back position, the unit is easy to transport by availing of handles 82 and the transverse rail 48 at the rearward end of the base frame.

As mentioned, the unit may have a collapsed or retracted height of about 71 inches and an extended height of about 16 feet 6 inches. The unit as illustrated is about 36 inches overall in length and about 34 inches in width. The extensible column is formed of anodized Teflon coated aluminum elements. The lights, as mentioned, may consist of a high intensity quartz iodine lamp, each drawing about 1,000 watts.

The engine of the engine-generator set may be about an eight horsepower engine and the generator, which is in the form of an alternator, can produce about 3,000 watts steady with provision for substantial charge current and supplies, as mentioned, both the 110 and 220 volt outlets and, via suitable circuitry, can also provide the charging current for the 12 volt battery 76, if so desired.

It has been found that the unit according to the present invention can be completely set up in about 30 seconds and can, similarly, be collapsed, ready for transport, in a comparable length of time.

Modifications may be made within the scope of the appended claims.

What is claimed is:

1. A self-contained illuminating tower comprising:

a base frame, a multiple section extensible column on said base frame moveable between lower retracted and upper extended positions, said column including at least an upper section and a lower section, electric illuminating means mounted on the upper end of the upper section of said column, electric generator means of said base frame adapted to supply power to said illuminating means, actuating means on said base for extending said column, and brace means connected to said base frame for bracing the tower when said column is extended, said brace means comprising a pair of arm members and means connecting said arm members to said base frame for enabling said arm members to be extended laterally outwardly from said base frame in bracing positions when said column is extended and to be retracted to compact storage positions in close proximity to said base frame when said tower is not in use.

2. A self-contained illuminating tower comprising:

a base frame, a multiple section extensible column on said base frame moveable between lower retracted and upper extended positions, said column including at least an upper section and a lower section, electric illuminating means mounted on the upper end of the upper section of said column, electric generator means on said base frame adapted to supply power to said illuminating means, actuating means on said base for extending said column, said actuating means comprising a container of compressed gas and means operatively connecting said compressed gas to said column for extending said column, and brace means connected to said base frame for bracing said tower when said column is extended, said brace means comprising a pair of arm members and means connecting said arm members to said base frame for enabling said arm members to be extended laterally outwardly from said base frame in bracing positions when said column is extended and to be retracted to compact storage positions in close proximity to said base frame when said tower is not in use.

3. An illuminating tower according to claim 2 wherein said column includes an upper section rotatable relative to said base frame.

4. An illuminating tower according to claim 3 wherein said upper section is rotatable through at least 360° relative to said base frame.

5. An illuminating tower according to claim 2 in which the sections of said column are telescopically engaged and slide relative to one another in moving between retracted and extended positions of said column, and wherein said means operatively connecting said compressed gas to said column comprises a valved conduit.

6. An illuminating tower according to claim 2 which includes a laterally extending support member connected in about the middle to the upper end of said upper section of said column, said illuminating means comprising a light fixture supportingly connected to each end region of said support member.

7. An illuminating tower according to claim 2 in which said base frame comprises tubular elements interconnected to form a frame which is cubical in outline with parallel front and rear ends and parallel sides.

8. An illuminating tower according to claim 2 which includes means for supplying a lubricant to said gas thereby to lubricate said column sections.

9. An illuminating tower according to claim 2 in which said generator means includes an end panel near one end of said base frame, and receptacle means in said panel and connected to the generator means for being energized thereby.

10. An illuminating tower according to claim 2 in which the lower section of said column has a base plate fixed thereto, axially extending radial brace elements between the base plate and the lower end of said lower section, and support members in said base frame to which said plate is attached.

11. An illuminating tower comprising:

a base frame, a multiple section extensible column on said base frame movable between lower retracted and upper extended positions, said column including at least an upper section and a lower section, electric illuminating means mounted on the upper end of the upper section of said column, electric generator means on said base frame adapted to supply power to said illuminating means, actuating means on said base frame for supplying power to said column for the extension thereof from its retracted position, and brace means connected to said base frame for bracing the tower when said column is extended, said brace means comprising a pair of arm members each having one end swingably connected to a respective side of said base frame and having a ground engaging pad mounted on the other end and means for adjustably extending said pads from their respective arm members.

12. An illuminating tower according to claim 11 in which each arm member includes a handle near said one end thereof.

13. An illuminating tower according to claim 11 in which each arm member is foldable against the respective side of said base frame.

14. An illuminating tower comprising:

a base frame, a multiple section extensible column on said base frame movable between lower retracted and upper extended positions, said column including at least an upper section and a lower section, electric illuminating means mounted on the upper end of the upper section of said column, electric generator means on said base frame adapted to supply power to said illuminating means, actuating means on said base frame for supplying power to said column for the extension thereof from its retracted position, and brace means connected to said base frame for bracing the tower when said column is extended, said base frame comprising laterally spaced side portions and means extending therebetween for supporting said column, said brace means comprising an arm member extending along each side of said base frame and having one end connected for pivotal movement on a vertical axis to the forward edge of the respective side portion and having a vertically adjustable ground engaging pad on the other end, each arm member having a hand graspable handle near said one end thereof which extends outwardly at an angle to the respective arm member when the arm member is flat against the respective side of said base frame.

15. An illuminating tower according to claim 14 in which said handles abut the forward end of the base frame when said arm members are swung outwardly into bracing position.

16. An illuminating tower according to claim 15 which includes a bar adapted to interconnect said arms when said handles abut the forward end of said base frame.

17. An illuminating tower according to claim 14 in which said handles abut the forward end of the base frame when said arm members are swung outwardly into bracing position, said base frame comprising a platform near the bottom, said generator means comprising an engine and a generator driven thereby and mounted on said platform.

18. An illuminating tower according to claim 14 in which said handles abut the forward end of the base frame when said arm members are swung outwardly into bracing position, said base frame comprising means to support a container of gas under pressure, a conduit connecting said container to said column and having a shut off valve therein, a relief valve connected to said conduit between said shut off valve and said column, and means for manually operating said relief valve to release gas from said column to the atmosphere.

* * * * *